United States Patent [19]

Hlawatschek et al.

[11] Patent Number: 4,648,097

[45] Date of Patent: Mar. 3, 1987

[54] ELECTRODE FOR AN ELECTRIC ARC FURNACE

[75] Inventors: Hartmut Hlawatschek, Mainz; Hans Leistner; Günter Gelsdorf, both of Wiesbaden, all of Fed. Rep. of Germany

[73] Assignee: Didier-Werke AG, Wiesbaden, Fed. Rep. of Germany

[21] Appl. No.: 793,289

[22] Filed: Oct. 31, 1985

[30] Foreign Application Priority Data

Nov. 2, 1984 [DE] Fed. Rep. of Germany ..... 3440073

[51] Int. Cl.[4] ..... H05B 7/085

[52] U.S. Cl. ..... 373/93

[58] Field of Search ..... 373/88, 90, 91, 92, 373/93

[56] References Cited

U.S. PATENT DOCUMENTS

| | | | |
|---|---|---|---|
| 4,446,561 | 5/1984 | Zöllner et al. | 373/93 |
| 4,451,926 | 5/1984 | Hogg, Jr. et al. | 373/93 |
| 4,462,104 | 7/1984 | Zöllner et al. | 373/93 |
| 4,466,105 | 8/1984 | Bauer et al. | 373/93 |

FOREIGN PATENT DOCUMENTS

| | | |
|---|---|---|
| 2725537 | 12/1978 | Fed. Rep. of Germany . |
| 3102776 | 8/1982 | Fed. Rep. of Germany . |
| 2037549 | 7/1980 | United Kingdom . |

OTHER PUBLICATIONS

"Stahl und Eisen 104" (1984), No. 1, pp. 33–36.

*Primary Examiner*—Roy N. Envall, Jr.
*Attorney, Agent, or Firm*—Wenderoth, Lind & Ponack

[57] ABSTRACT

An electrode for an electric arc furnace includes a cooled metal sheath covered with a refractory protective jacket. A plurality of refractory anchors are fixed to the exterior of the sheath, and the anchors are spaced from each other. The protective jacket includes an undercoat on the exterior of the sheath and a protective layer over the undercoat and extending between the anchors. The protective layer is formed of a refractory material such that, at the operating temperature of the electrode, the protective layer has an inner zone which is thermoplastic and an outer zone which is rigid or which is a high-viscosity melting phase.

19 Claims, 1 Drawing Figure

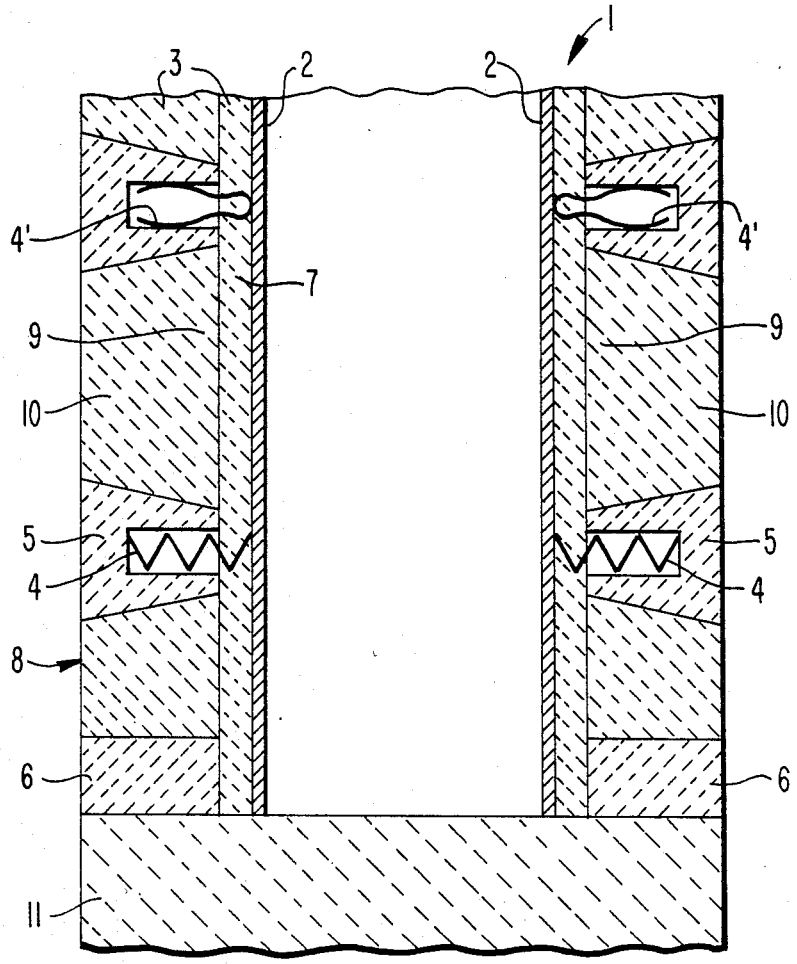
1
2
2
3
4'
4'
7
9
9
10
10
5
5
4
4
8
6
6
11

ELECTRODE FOR AN ELECTRIC ARC FURNACE

BACKGROUND OF THE INVENTION

The present invention relates to a graphite electrode for an electric arc furnace and of the type including a cooled metal, for example steel, sheath which is covered by a protective refractory jacket.

Such an electrode is described in the journal "STAHL UND EISEN 104" (1984) No. 1, pages 33–36, in which, to protect the metal sheath against electric sparkover, a composite structure of ceramics and graphite is deposited on a central part, and additionally wherein graphite rings may be screwed thereonto.

SUMMARY OF THE INVENTION

The primary object of the present invention is to provide such an electrode whereby it is possible to prevent the protective layer of the electrode from peeling off the sheath and to increase the strength of the protective layer, especially with regard to mechanical stresses, while at the same time preventing electrical sparkover.

This object is achieved in accordance with the present invention by attaching to the outside of the sheath, sometimes with allowance for sliding and spaced a distance from each other, a plurality of refractory anchors, for example formed of a fired refractory ceramic material, with the protective layer extending between the anchors. The protective layer is formed of a refractory material that, at the operating temperature of the electrode, is thermoplastic in an inner zone of the layer toward the sheath.

In accordance with a first embodiment of the present invention, the protective layer, at such operating temperature of the electrode, is rigid in its outer zone. Because of this structure, the protective layer does not peel off, even when the electrode vibrates vigorously. The plurality of anchors retain the protective layer and also absorb temperature stresses. The strength of the rigid outer zone of the protective layer offers an effective protection for the sheath, while the plastic inner zone provides an intimate bond with an undercoat.

In accordance with a second embodiment of the present invention the protective layer, at the operating temperature of the electrode, has a high-viscosity ceramic melting phase at its outer zone. This embodiment of the present invention offers the same advantages as the previously discussed first embodiment. The only difference is that the effective protection for the sheath against mechanical stresses is not achieved by a protective layer which is hard or rigid on the outside, but rather by a protective layer which is relatively soft on the outer side at the operating temperature of the electrode and which brings about a type of self-healing effect in the event of damage. Thus, if the protective layer is damaged, for instance by a piece of scrap during charging of the furnace, the material of the high-viscosity melting phase will flow into the resulting damaged area, such as a crack, thereby filling such damaged area.

In accordance with a further feature of the present invention, there is provided an adhesive undercoat deposited on the sheath as a backing layer for the protective layer. If this undercoat is aluminum oxide, it is electrically insulating.

The undercoat also may be formed of a graphite material with a bonding agent such as phenolic or epoxide resin. This ensures satisfactory heat transfer from the protective layer to the sheath, particularly with a steel sheath.

Furthermore, the undercoat may consist of a refractory fibrous mat material based on alumina silicate fibers reinforced with a ceramic phosphate-bearing bonding agent.

Preferably, the ceramic protective layer consists of an aluminous (i.e. rich in alumina) granular material with bonding agents and optionally plasticizers. This ensures a high mechanical strength in the outer zone of the protective layer.

BRIEF DESCRIPTION OF THE DRAWING

Other objects, features and advantages of the present invention will be apparent from the following description, taken with the accompanying drawing, wherein the single FIGURE is a somewhat schematic cross sectional view of a graphite electrode with a protected steel sheath in accordance with one embodiment of the present invention.

DETAILED DESCRIPTION OF THE INVENTION

The electrode 1 shown in the drawing includes, in a generally known manner, an erosion part 11 and a steel sheath 2 which is cooled by guide channels for water (not shown).

The steel sheath 2 is protected against electrical sparkover and mechanical stresses by a refractory protective sheath 3 formed as described below in a novel manner according to the present invention.

Thus, attached, for example by welding, to the exterior of steel sheath 2 are a plurality of helical springs 4 (or other shaped springs such as clamp springs 4'). The springs are distributed throughout the length of the steel sheath 2 and also are distributed around the annular periphery thereof. Mounted on each spring, for example by cementing, is an anchor 5 consisting of a fired refractory ceramic material. In the illustrated arrangement, each anchor 5 has a dimension or shape tapering inwardly in a direction toward sheath 2. A preferable material for anchors 5 is a mixture of approximately 50 weight percent $Al_2O_3$ and approximately 50 weight percent $ZrO_2$. Those skilled in the art however will understand from the present description other possible compositions of the anchors 5. By this manner of mounting of the anchors 5 the anchors are provided with a certain degree of freedom of movement relative to the sheath.

Refractory sheath 3 includes an undercoat 7 deposited on the steel sheath 2 and a ceramic protective layer 8 deposited on the undercoat 7. Protective layer 8 extends between the anchors 5 and between a sealing ring 6 and anchors 5. Protective layer 8 and undercoat 7 together have a thickness, for example, of about 20–55 mm. At the most, the protective layer 8 overhangs anchors 5 only to an insignificant extent.

Undercoat 7 is designed such that it adheres well to steel sheath 2. Protective layer 8 will not peel off even if vibrations occur during operation, and additionally protective layer 8 is resistant to mechanical stresses. To this end, protective layer 8 has an inner zone 9 designed to remain at least to some degree plastic. Specifically, at the operating temperature of the electrode, the inner zone 9 is thermoplastic.

In accordance with a first embodiment of the present invention, the outer zone 10 of protective layer 8 has great mechanical strength and a tight rigid surface. Together, undercoat 7 and protective layer 8 are electrically insulating.

In accordance with a second embodiment of the present invention, the protective layer 8 has its outer zone 10 as an effective high-viscosity melting phase which, should the protective layer be damaged, achieves a self-healing thereof.

In the first embodiment of the present invention, the protective layer 7 consists of a layer of flame-sprayed $Al_2O_3$ which is thin in relation to protective layer 8 and which is electrically insulating. Protective layer 8 consists of a mixture of bauxite and tabular alumina having the composition:

70–90 weight percent bauxite and tabular alumina (grain size between 0 and 3 mm)
0–3 weight percent green, fine-grain $Cr_2O_3$
1–4 weight percent plastic clay and/or bentonite
1–2 weight percent boric acid
0–2 weight percent boric acid anhydride
0–4 weight percent slightly soluble aluminum phosphate
5–15 weight percent silicon paste or silicon oil
2–4 weight percent water.

At temperatures of from about 800° C. to 1,000° C., the outer zone 10 is rigid and has a tightly sintered surface. By contrast, the inner zone 9 is rigid but is plastically resilient. Thermal stress of the protective layer 8 thus is absorbed by the resilient anchors 5 which also damp stresses due to vibrations at the outer zone 10.

In the second embodiment of the invention, the undercoat 7 is formed of a graphite mass bound by a synthetic resin, for example lamellar graphite to which is added as a bonding agent 3 to 7 weight percent of a synthetic resin such as phenolic or epoxide resin. In addition, the graphite mass may contain 3 to 10 weight percent silicon paste. The protective layer 8 consists of a layer of bauxite and tabular alumina having the following composition:

65–90 weight percent bauxite and tabular alumina (grain size between 0 and 3 mm)
4–12 weight percent plastic clay and/or bentonite
0–3 weight percent green fine-grain $Cr_2O_3$
2–4 weight percent boric acid
0–4 weight percent boric acid anhydride
0–4 weight percent slightly soluble aluminum phosphate 3–9 weight percent water.

The high-viscosity melting phase which brings about the above mentioned self-healing effect when the protective layer is damaged is achieved by reactions of the large proportion of bentonite with the bonding agent boric acid and/or boric acid anhydride.

Although the present invention has been described with respect to specifically preferred embodiments of the present invention, including specifically preferred compositions of the various materials thereof, it is to be understood that various modifications and changes may be made to the specifically described embodiments without departing from the scope of the present invention. It particularly is to be understood that other compositions that the above described specific compositions may be provided, as would be understood by one skilled in the art, as long as the above discussed characteristics are achieved.

We claim:

1. In an electrode for an electric arc furnace, said electrode being of the type including a cooled sheath covered with a refractory protective jacket, the improvement comprising:

a plurality of refractory anchors fixed to the exterior of said sheath, said anchors being spaced from each other; and said protective jacket comprising a protective layer extending between said anchors, said protective layer being formed of a refractory material such that, at the operating temperature of said electrode, said protective layer has an inner zone which is thermoplastic.

2. The improvement claimed in claim 1, wherein said protective layer, at said operating temperature of said electrode, has a rigid outer zone.

3. The improvement claimed in claim 2, wherein said refractory material is a granular material rich in alumina and a bonding agent.

4. The improvement claimed in claim 3, wherein said refractory material further includes a plasticizer.

5. The improvement claimed in claim 3, wherein said refractory material comprises tabular alumina or a mixture of bauxite and tabular alumina with a grain size between 0 and 3 mm.

6. The improvement claimed in claim 5, wherein said refractory material comprises:

70–90 weight percent bauxite and tabular alumina (grain size between 0 and 3 mm)
0–3 weight percent green, fine-grain $Cr_2O_3$
1–4 weight percent plastic clay and/or bentonite
1–2 weight percent boric acid
0–2 weight percent boric acid anhydride
0–4 weight percent slightly soluble aluminum phosphate
5–15 weight percent silicon paste or silicon oil
2–4 weight percent water.

7. The improvement claimed in claim 1, wherein said protective layer, at said operating temperature of said electrode, has an outer zone of a high-viscosity melting phase.

8. The improvement claimed in claim 7, wherein said refractory material is a granular material rich in alumina and a bonding agent.

9. The improvement claimed in claim 8, wherein said refractory material further includes a plasticizer.

10. The improvement claimed in claim 8, wherein said refractory material comprises tabular alumina or a mixture of bauxite and tabular alumina with a grain size between 0 and 3 mm.

11. The improvement claimed in claim 10, wherein said refractory material comprises:

65–90 weight percent bauxite and tabular alumina (grain size between 0 and 3 mm)
4–12 weight percent plastic clay and/or bentonite
0–3 weight percent green fine-grain $Cr_2O_3$
2–4 weight percent boric acid
0–4 weight percent boric acid anhydride
0–4 weight percent slightly soluble aluminum phosphate
3–9 weight percent water.

12. The improvement claimed in claim 1, further comprising an adhesive undercoat deposited on said sheath as a backing layer for said protective layer.

13. The improvement claimed in claim 12, wherein said undercoat comprises aluminum oxide.

14. The improvement claimed in claim 12, wherein said undercoat comprises a graphite material with a bonding agent such as phenolic or epoxide resin.

15. The improvement claimed in claim 14, wherein said undercoat further includes silicon paste.

16. The improvement claimed in claim 12, wherein said undercoat comprises a refractory fibrous material based on aluminousilicate fibers reinforced with a ceramic phosphate-bearing bonding agent.

17. The improvement claimed in claim 1, wherein said anchors are formed of a fired ceramic material.

18. The improvement claimed in claim 1, further comprising springs connecting said anchors to said sheath.

19. The improvement claimed in claim 1, wherein each said anchor has a shape tapering inwardly in a direction toward said sheath.

* * * * *